US008425097B2

(12) United States Patent
Yamamoto

(10) Patent No.: US 8,425,097 B2
(45) Date of Patent: Apr. 23, 2013

(54) LAMP UNIT

(75) Inventor: Ippei Yamamoto, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 13/177,102

(22) Filed: Jul. 6, 2011

(65) Prior Publication Data

US 2012/0008335 A1 Jan. 12, 2012

(30) Foreign Application Priority Data

Jul. 8, 2010 (JP) ..... 2010-156028

(51) Int. Cl.
*F21V 7/00* (2006.01)
*F21S 8/00* (2006.01)

(52) U.S. Cl.
USPC ..... 362/539; 362/517; 362/519; 362/546; 362/549

(58) Field of Classification Search ..... None
See application file for complete search history.

(56) References Cited

U.S. PATENT DOCUMENTS

2006/0120094 A1 6/2006 Tsukamoto et al.
2008/0112180 A1* 5/2008 Okada ..... 362/518
2010/0118559 A1* 5/2010 Nakada ..... 362/539
2010/0194276 A1* 8/2010 Okubo et al. ..... 315/82

FOREIGN PATENT DOCUMENTS

EP 1 267 116 A1 12/2002
JP 2005-108554 A 4/2005
JP 2007-287610 A 11/2007

OTHER PUBLICATIONS

Extended European Search Report issued in the corresponding European Application No. 11172883.8 dated Sep. 27, 2011.

* cited by examiner

*Primary Examiner* — Ashok Patel
(74) *Attorney, Agent, or Firm* — Sughrue Mion, PLLC

(57) ABSTRACT

A lamp unit includes: a first board supporting a first LED; a second board supporting a second LED; a first reflector that is disposed so as to reflect, toward a projection lens, light emitted by the first LED; a second reflector that is disposed so as to reflect, toward the projection lens, light emitted by the second LED; and a shade that blocks part of light reflected by the first reflector. The first and second boards support the first and second LEDs so that the first and second LEDs are disposed on opposite sides with respect to an optical axis Ax of the projection lens. The first reflector is disposed on the side opposite to the first LED with respect to the optical axis Ax, and the second reflector is disposed on the side opposite to the second LED with respect to the optical axis Ax.

6 Claims, 5 Drawing Sheets

LAMP UNIT

INCORPORATION BY REFERENCE

The disclosure of Japanese Patent Application No. 2010-156028 filed on Jul. 8, 2010 including the specification, drawings and abstract is incorporated herein by reference in its entirety.

BACKGROUND OF THE INVENTION

1. Field of the Invention

The invention relates to a lamp unit used for a vehicular headlamp.

2. Description of Related Art

Vehicular headlamps, in which semiconductor light emitting elements, such as light emitting diodes (LEDs), are used as the light sources, have already been available. Japanese Patent Application Publication No. 2005-108554 (JP-A-2005-108554), for example, describes a lamp unit for a vehicular headlamp, in which first and second semiconductor light emitting elements are arranged back to back. In this lamp unit, the light from the first semiconductor light emitting element and the light from the second semiconductor light emitting element are reflected by a first reflector and a second reflector, respectively, that are provided, relative to the first and second semiconductor light emitting elements, in the directions of the light emission of the first and second semiconductor light emitting elements, toward the vicinity of the light source-side focal point of the projection lens and are thrown ahead of the vehicle through the projection lens.

When the first and second semiconductor light emitting elements are arranged back to back as in the case of the lamp unit described in JP-A-2005-108554, however, the light unit can become large because of the presence of the first and second reflectors.

SUMMARY OF THE INVENTION

The invention provides a technology for reducing the size of a lamp unit.

A lamp unit according to an aspect of the invention includes: a first light source; a first light source supporting portion that supports the first light source; a second light source; a second light source supporting portion that supports the second light source; a projection lens; a first reflector that is disposed so as to reflect, toward the projection lens, light emitted by the first light source; a second reflector that is disposed so as to reflect, toward the projection lens, light emitted by the second light source; and a shade that blocks part of light reflected by the first reflector or the second reflector. The first light source supporting portion and the second light source supporting portion support the first light source and the second light source so that the first light source and the second light source are disposed on opposite sides with respect to an optical axis of the projection lens, the first reflector is disposed on a side opposite to the first light source with respect to the optical axis of the projection lens, and the second reflector is disposed on a side opposite to the second light source with respect to the optical axis of the projection lens.

The second reflector may be disposed at a position that is closer to the projection lens than the first light source.

A configuration may be employed, in which the first reflector and the second reflector are arranged so as to face each other and the first light source supporting portion and the second light source supporting portion support the first light source and the second light source, respectively, so that part of an optical path from the first light source to the first reflector and part of an optical path from the second light source to the second reflector overlap each other.

The first reflector may have an aperture that has at least one of a function of avoiding interference between the first reflector and the second light source and a function of allowing the light emitted by the second light source to pass toward the second reflector.

The first reflector may be provided with a level difference between opposite edges of the aperture.

A configuration may be employed, in which the first reflector has a reflecting surface along a first ellipse that has focuses at a center of light emission of the first light source and at a light-source side focal point of the projection lens in a plane including the optical axis, the second reflector has a reflecting surface along a second ellipse that has focuses at a center of light emission of the second light source and at the light-source side focal point of the projection lens in the plane, and substantially half or more of a quarter of the first ellipse and substantially half or more of a quarter of the second ellipse overlap each other when viewed along the optical axis in the plane, the quarter of the first ellipse being on a side far from the projection lens and on a second light source side in the first ellipse, the quarter of the second ellipse being on the side far from the projection lens and on a first light source side in the second ellipse.

BRIEF DESCRIPTION OF THE DRAWINGS

Features, advantages, and technical and industrial significance of exemplary embodiments of the invention will be described below with reference to the accompanying drawings, in which like numerals denote like elements, and wherein:

FIGS. 3A and 3B are diagrams each for explaining the light distribution pattern formed when one of the first LED and the second LED is turned on;

DETAILED DESCRIPTION OF EMBODIMENTS

Embodiments of the invention will be described in detail below with reference to the drawings.

Figure 1:
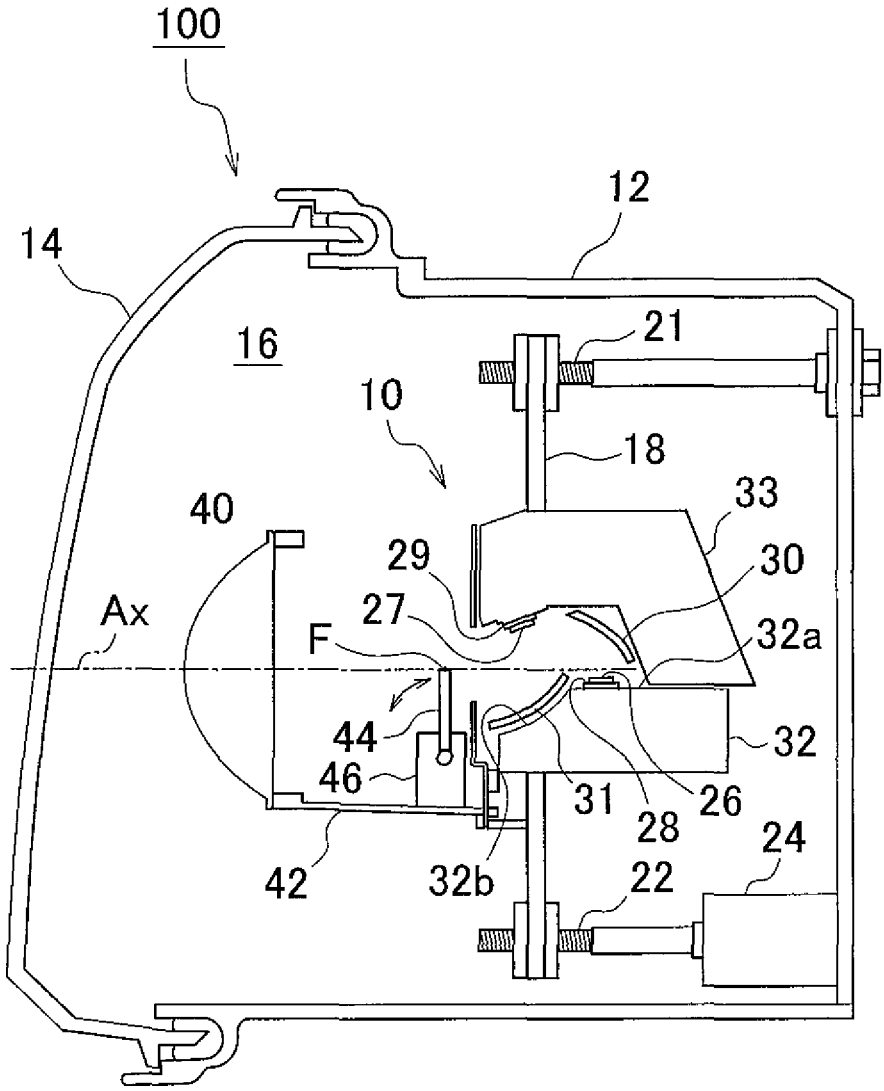
FIG. 1 is a cross-sectional view of a vehicular headlamp using a lamp unit according to an embodiment of the invention.

FIG. 1 shows a cross-sectional view of a vehicular headlamp 100 using a lamp unit 10 according to an embodiment of the invention. As shown in FIG. 1, the vehicular headlamp 100 includes: a lamp body 12 having a recess that opens forward with respect to the lamp; and a cover 14 that closes the opening of the lamp body 12. The internal space formed by the lamp body 12 and the cover 14 serves as a lamp chamber 16.

The lamp unit 10 is disposed in the lamp chamber 16. As shown in FIG. 1, the lamp unit 10 is fitted to substantially the center of a bracket 18. A first aiming screw 21 is fitted to an upper portion of the bracket 18 and a second aiming screw 22 is fitted to a lower portion of the bracket 18. The bracket 18 is tiltably supported by the lamp body 12 via the first aiming screw 21 and the second aiming screw 22. The lower, second aiming screw 22 is provided with an aiming actuator 24. When the aiming actuator 24 is driven, the lamp unit 10 is tilted as the bracket 18 is tilted, whereby the light axis adjustment (aiming adjustment) is performed.

The lamp unit 10 includes a first light emitting diode (LED) 26, a second LED 27, a first board 28, a second board 29, a first reflector 30, a second reflector 31, a first heat sink 32, a second heat sink 33, a projection lens 40, a lens supporting member 42, a shade 44, and a shade actuator 46.

The projection lens 40 is provided at a front end portion of the lamp unit 10. The projection lens 40 is an aspherical plano-convex lens that has a convex surface on the front side and a flat surface on the back side and projects, in the form of an inverted image ahead of the vehicular headlamp 100, the light source image that is formed at the light source-side focal plane. The projection lens 40 is arranged so that the optical axis Ax thereof is substantially parallel to the longitudinal direction of the vehicle, in which the vehicular headlamp 100 is provided. The projection lens 40 is fixed to the bracket 18 via the lens supporting member 42.

As shown in FIG. 1, the first heat sink 32 and the second heat sink 33 are provided behind the projection lens 40. The first heat sink 32 has a generally rectangular shape when viewed from a side. On the other hand, the second heat sink 33 has a generally L shape when viewed from a side and is provided above the first heat sink 32 in a state where the character "L" is rotated 180°. When the first heat sink 32 and the second heat sink 33 are combined, these have a generally C shape when viewed from a side. The first heat sink 32 and the second heat sink 33 are fixed to the bracket 18.

The first board 28 is provided on an upper surface 32*a* of the first heat sink 32 and the first LED 26 is provided on the first board 28. On the first board 28, a circuitry for supplying electric power to the first LED 26 and a supporting portion for supporting the first LED 26 are formed. The first LED 26 is disposed so that the light emitting surface thereof faces vertically upward. In addition, the first LED 26 is disposed so that the light emitting surface thereof is positioned below the optical axis Ax.

The first reflector 30 that reflects, toward the projection lens 40, the light emitted by the first LED 26 is disposed above the first LED 26. The first reflector 30 is disposed on a side opposite to the first LED 26 with respect to the optical axis Ax of the projection lens 40 and is fixed to the second heat sink 33. The first reflector 30 is designed to have an elliptical reflecting surface that has the focuses at the center of light emission of the first LED 26 and the light source-side focal point F of the projection lens 40. The light from the first LED 26 reflected by the first reflector 30 is mainly thrown to a region below the horizontal line perpendicularly intersecting the optical axis Ax in front of the vehicle.

The second board 29 is provided on a portion of the second heat sink 33 further forward than the first reflector 30 and the second LED 27 is provided on the second board 29. On the second board 29, a circuitry for supplying electric power to the second LED 27 and a supporting portion for supporting the second LED 27 are formed. The second LED 27 is disposed so that the light emitting surface thereof faces slightly rearward relative to the vertically downward direction. In addition, the second LED 27 is disposed so that the light emitting surface thereof is positioned above the optical axis Ax. Thus, in the embodiment, the first board 28 and the second board 29 support the first LED 26 and the second LED 27, respectively, so that the first LED 26 and the second LED 27 are disposed on opposite sides with respect to the optical axis Ax of the projection lens 40.

The second reflector 31 that reflects the light, emitted by the second LED 27, toward the projection lens 40 is disposed below the second LED 27. The second reflector 31 is disposed on a side opposite to the second LED 27 with respect to the optical axis Ax of the projection lens 40 and is fixed to the first heat sink 32 in a concave portion 32*b* formed in a portion of the first heat sink 32 further forward than the first LED 26. Thus, in the embodiment, the second reflector 31 is disposed at a position closer to the projection lens 40 than the first LED 26. The second reflector 31 is designed to have an elliptical reflecting surface that has the focuses at the center of light emission of the second LED 27 and the light source-side focal point F of the projection lens 40. The light from the second LED 27 reflected by the second reflector 31 is mainly thrown to a region above the horizontal line perpendicularly intersecting the optical axis Ax in front of the vehicle.

The shade 44 is a plate-like member disposed between the second reflector 31 and the projection lens 40 and an upper end edge portion of the shade 44 is formed to have a shape corresponding to the cut line of the low-beam distribution pattern. In this embodiment, the shade 44 is designed to be moved, by the shade actuator 46, between a blocking position, in which part of the light from the first reflector 30 is blocked, and an open position, in which the light is not blocked. The shade actuator 46 may be a motor or a solenoid and is disposed on the lens supporting member 42.

FIG. 1 shows a state where the shade 44 is in the blocking position. When the shade 44 is in the blocking position, the shade 44 is in a vertically standing state and the upper end edge portion of the shade 44 is positioned close to the light source-side focal point F of the projection lens 40. When the shade 44 is in the blocking position, the light from the first LED 26 reflected by the first reflector 30 is emitted through the projection lens 40 with part of the light blocked by the shade 44. When the shade actuator 46 is driven from a state shown in FIG. 1, the shade 44 is rotated forward with respect to the lamp and is brought into a state where the shade 44 is substantially parallel to the optical axis Ax at last. In this state, the shade 44 is in the open position and the light from the first reflector 30 is emitted through the projection lens 40 without being blocked by the shade 44.

Figure 2:
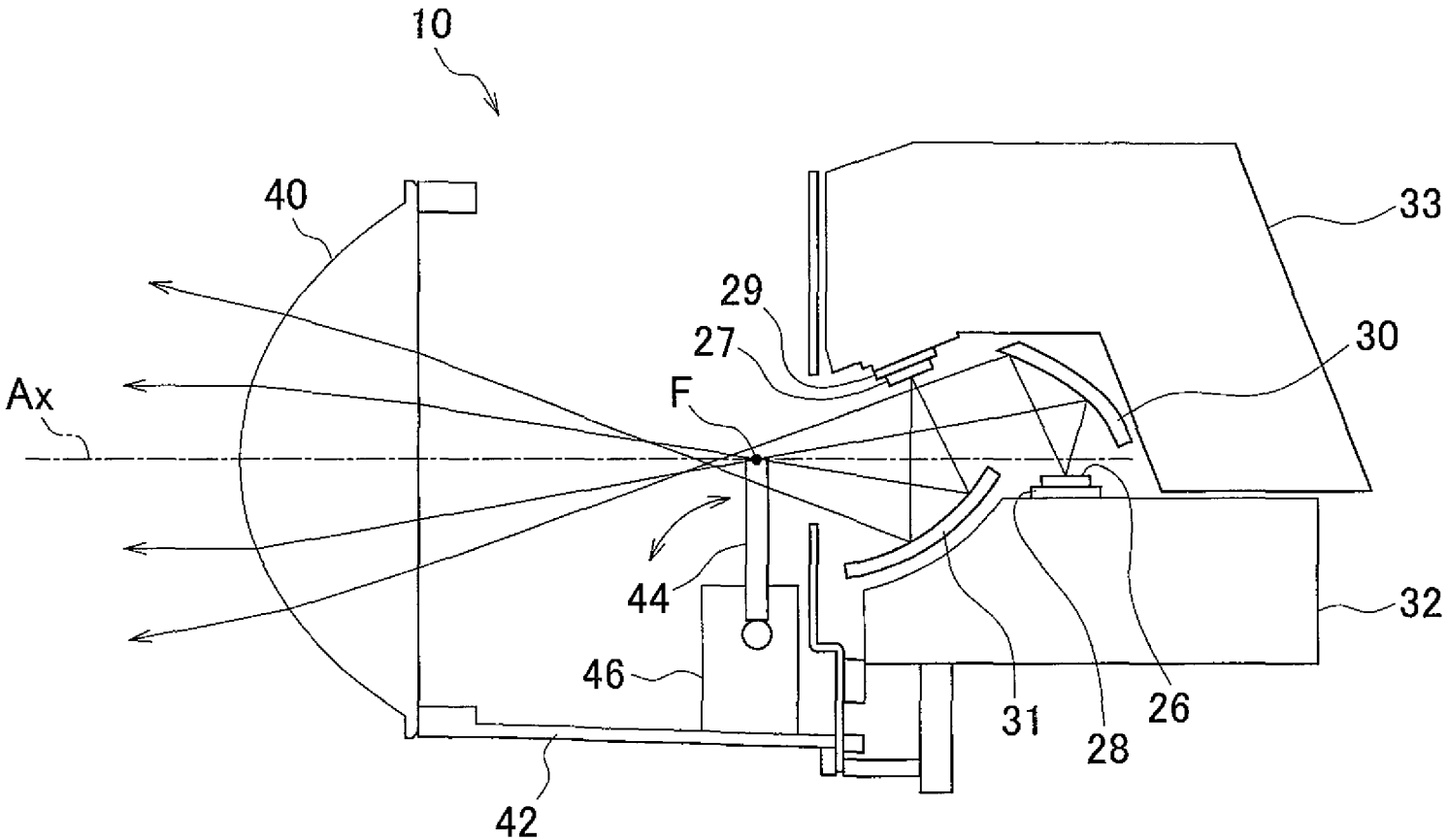
FIG. 2 is a diagram for explaining the optical paths of the light emitted by a first LED and a second LED.
Figure 3B:
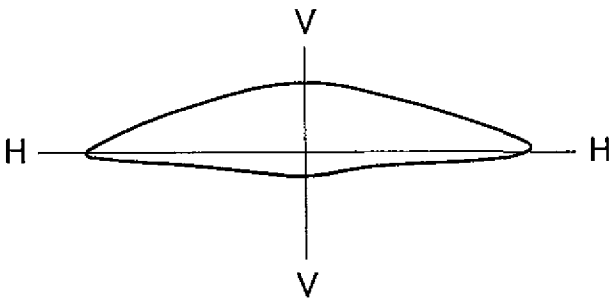
Figure 3A:
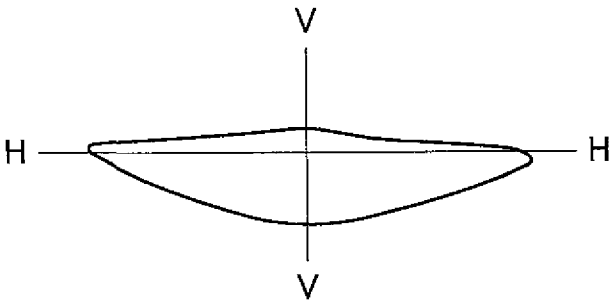

Next, a light distribution pattern formed by the lamp unit 10 according to the embodiment will be described. FIG. 2 is a diagram for explaining the optical paths of the light emitted by the first LED 26 and the second LED 27. FIGS. 3A and 3B are diagrams each for explaining the light distribution pattern formed when one of the first LED 26 and the second LED 27 is turned on. FIGS. 3A and 3B show the light distribution patterns formed on an imaginary vertical screen placed at a position 25 m ahead of the vehicular headlamp 100 including the lamp unit 10. FIGS. 3A and 3B show the light distribution patterns when the shade 44 is in the open position.

As shown in FIG. 2, the light emitted by the first LED 26 is reflected by the first reflector 30 and the light then passes through or near the light source-side focal point F of the projection lens 40 and is thrown forward with respect to the lamp through the projection lens 40. FIG. 3A shows the light distribution pattern formed by the light emitted by the first LED 26. As shown in FIG. 3A, the light emitted by the first LED 26 is mainly thrown to a region below the horizontal line H-H perpendicularly intersecting the optical axis Ax in front of the vehicle.

On the other hand, as shown in FIG. 2, the light emitted by the second LED 27 is reflected by the second reflector 31 and the light then passes through or near the light source-side focal point F of the projection lens 40 and is thrown forward with respect to the lamp through the projection lens 40. FIG.

3B shows the light distribution pattern formed by the light emitted by the second LED 27. As shown in FIG. 3B, the light emitted by the second LED 27 is mainly thrown to a region above the horizontal line H-H perpendicularly intersecting the optical axis Ax in front of the vehicle.

Figure 4A:
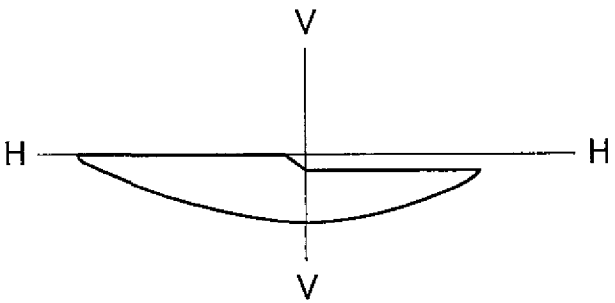
FIGS. 4A and 4B are diagrams for explaining the light distribution patterns that can be formed by the lamp unit according to the embodiment.
Figure 4B:
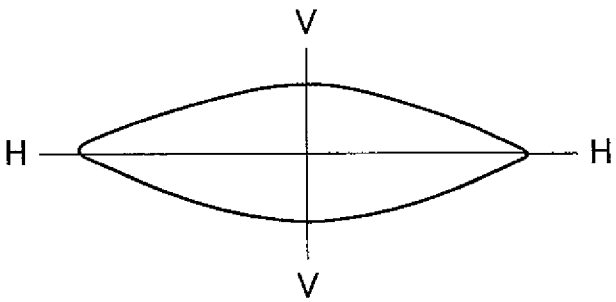

FIGS. 4A and 4B are diagrams for explaining the light distribution patterns that can be formed by the lamp unit 10 according to the embodiment. With the lamp unit 10 according to the embodiment, a low-beam distribution pattern and a high-beam distribution pattern can be formed by controlling turning on and off of the first LED 26 and the second LED 27 and the position of the shade 44.

When the first LED 26 is turned on, the second LED 27 is turned off, and the shade 44 is brought into the blocking position, part of the light emitted by the first LED 26 and reflected by the first reflector 30 is blocked by the shade 44, so that the low-beam distribution pattern as shown in FIG. 4A is formed.

When the first LED 26 and the second LED 27 are turned on and the shade 44 is brought into the open position, the light emitted by the first LED 26 and reflected by the first reflector 30 and the light emitted by the second LED 27 and reflected by the second reflector 31 are both thrown through the projection lens 40, so that the high-beam distribution pattern as shown in FIG. 4B is formed. The high-beam distribution pattern is a pattern obtained by combining the two light distribution patterns shown in FIGS. 3A and 3B.

As described above, the lamp unit 10 according to the embodiment can form the low-beam distribution pattern and the high-beam distribution pattern by controlling turning on and off of the first LED 26 and the second LED 27 and the position of the shade 44. Because it is possible to form the two different light distribution patterns with a single lamp unit, it is possible to reduce the size of the vehicular headlamp 100.

In addition, in the lamp unit 10 according to the embodiment, the first LED 26 and the second LED 27 are disposed on opposite sides with respect to the optical axis Ax of the projection lens 40, the first reflector 30 is disposed on a side opposite to the first LED 26 with respect to the optical axis Ax of the projection lens 40, and the second reflector 31 is disposed on a side opposite to the second LED 27 with respect to the optical axis Ax of the projection lens 40. In addition, in the lamp unit 10 according to the embodiment, the second reflector 31 is disposed at a position closer to the projection lens 40 than the first LED 26. In other words, a first optical system including the first LED 26 and the first reflector 30 and a second optical system including the second LED 27 and the second reflector 31 are arranged longitudinally offset from each other in the direction of the optical axis Ax. With this configuration, it is possible to reduce the size of the lamp unit 10 as compared to the case where the first LED and the second LED are arranged back to back, for example.

Figure 5:
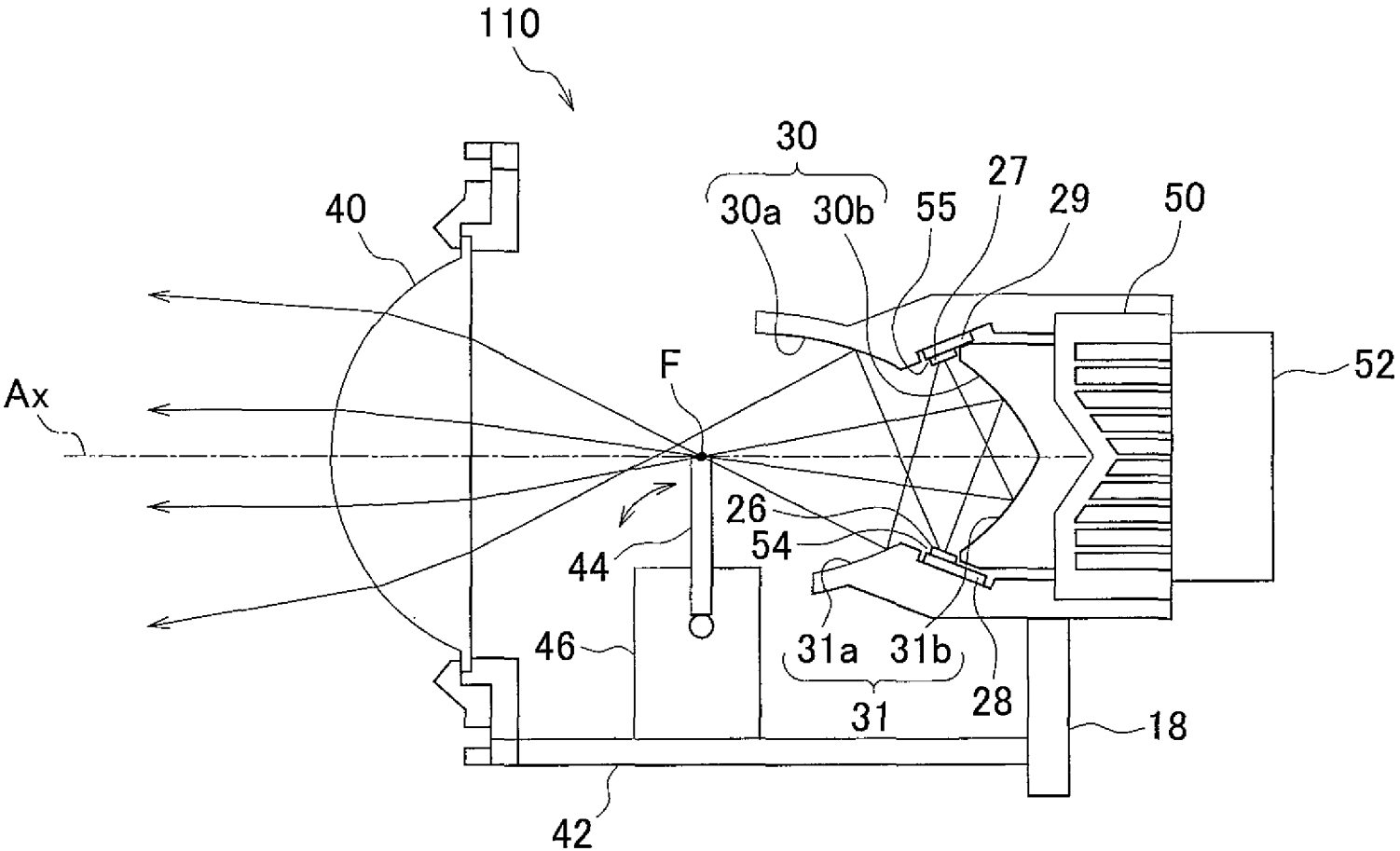
FIG. 5 is a cross-sectional view of a lamp unit according to another embodiment of the invention.

FIG. 5 is a cross-sectional view of the lamp unit 110 according to another embodiment of the invention. In the lamp unit 110 shown in FIG. 5, the constituent element the same as or corresponding to the corresponding element of the lamp unit 10 shown in FIG. 1 is designated by the same reference numeral and the description thereof is omitted as appropriate.

The lamp unit 110 shown in FIG. 5 differs from the lamp unit 10 shown in FIG. 1 in the arrangement of the first LED 26, the second LED 27, the first reflector 30, and the second reflector 31. In addition, the shape of the first reflector 30 and the shape of the second reflector 31 differ from those of the lamp unit 10 shown in FIG. 1.

As shown in FIG. 5, the first reflector 30 and the second reflector 31 are fixed to a heat sink 50. In addition, a fan 52 is provided for the heat sink 50.

Also in this embodiment, the first LED 26 and the second LED 27 are disposed on opposite sides with respect to the optical axis Ax of the projection lens 40, the first reflector 30 is disposed on a side opposite to the first LED 26 with respect to the optical axis Ax of the projection lens 40, and the second reflector 31 is disposed on a side opposite to the second LED 27 with respect to the optical axis Ax of the projection lens 40. In this embodiment, the first reflector 30 and the second reflector 31 are arranged so as to face each other. In addition, the first board 28 and the second board 29 support the first LED 26 and the second LED 27, respectively, so that part of the optical path from the first LED 26 to the first reflector 30 and part of the optical path from the second LED 27 to the second reflector 31 overlap each other. In this way, the first LED 26 and the second LED 27 are arranged so as to face each other.

In addition, in the lamp unit 110 according to this embodiment, a first aperture 55 is formed in the first reflector 30 and the second LED 27 is provided in the first aperture 55. The first aperture 55 makes it possible to avoid the interference between the first reflector 30 and the second LED 27 and at the same time allow the light emitted by the second LED 27 to pass toward the second reflector 31. In addition, in the lamp unit 110, a second aperture 54 is formed in the second reflector 31 and the first LED 26 is provided in the second aperture 54. The second aperture 54 makes it possible to avoid the interference between the second reflector 31 and the first LED 26 and at the same time allow the light emitted by the first LED 26 to pass toward the first reflector 30.

In addition, in the lamp unit 110 according to this embodiment, the first reflector 30 includes a first sub-reflector 30*a* in front of the first aperture 55 and a second sub-reflector 30*b* behind the first aperture 55. The first sub-reflector 30*a* is formed to have an F-number smaller than that of the second sub-reflector 30*b*. In this way, the first reflector 30 is provided with a level difference between opposite edges of the first aperture 55. In addition, the second reflector 31 includes a first sub-reflector 31*a* in front of the second aperture 54 and a second sub-reflector 31*b* behind the second aperture 54. The first sub-reflector 31*a* is formed to have an F-number smaller than that of the second sub-reflector 31*b*. In this way, the second reflector 31 is provided with a level difference between opposite edges of the second aperture 54.

The first sub-reflector 30*a* and the first sub-reflector 31*a* are formed to throw the light to a concentration region in the light distribution pattern, which is called a hot zone. The second sub-reflector 30*b* and the second sub-reflector 31*b* are formed to throw the light to a diffusion region around the hot zone.

When the reflector is provided with no level difference and an LED is disposed in the aperture of the reflector, for example, it becomes necessary to dispose the LED so that the light emitting surface of the LED is parallel to a direction tangent to the reflector, in order to allow light to be efficiently emitted through the aperture. In this case, however, it becomes difficult to dispose the LED at an angle that is optimum in view of the desired light distribution.

Thus, by providing the reflector with the level difference between opposite edges of the aperture as in the case of this embodiment, it becomes possible to allow light from the LED to be emitted through the level difference and it also becomes possible to change the angle of the LED. For example, it is possible to fix the LED so that the high-luminance direction of the LED in terms of the angular luminance distribution thereof is directed to the portion of the reflector that is considered to be important in view of the light distribution (the first sub-reflector 30*a* and the first sub-reflector 31*a* in this embodiment). As described above, with the lamp unit 110 according to this embodiment, it is possible to allow light to be efficiently emitted through the aperture to increase the efficiency of utilization of light and keep a high degree of freedom of the light distribution control.

The lamp unit 110 according to this embodiment also can form the low-beam distribution pattern and the high-beam distribution pattern by controlling turning on and off of the first LED 26 and the second LED 27 and the position of the shade 44. Because it is possible to form the two different light distribution patterns with a single lamp unit, it is possible to reduce the size of the vehicular headlamp.

In addition, the first LED 26, the second LED 27, the first reflector 30, and the second reflector 31 are arranged as described above, it is possible to reduce the size of the lamp unit as compared to the case where the first LED and the second LED are arranged back to back, for example.

The invention has been described above with reference to the embodiments. These embodiments are merely examples and those skilled in the art would understand that the combination of the constituent elements and the processes can be variously modified and that such modifications are also within the scope of the invention.

For example, although the LEDs are illustrated as the light sources in the above embodiments, the light source is not limited to the LED.

In addition, although the above embodiments are configured so that the shade 44 is rotatable, a configuration, in which the shade 44 is vertically movable, may be employed.

What is claimed is:

1. A lamp unit comprising:

a first light source;

a first light source supporting portion that supports the first light source;

a second light source;

a second light source supporting portion that supports the second light source;

a projection lens;

a first reflector that is disposed so as to reflect, toward the projection lens, light emitted by the first light source;

a second reflector that is disposed so as to reflect, toward the projection lens, light emitted by the second light source; and a shade that blocks part of light reflected by the first reflector or the second reflector, wherein the first light source supporting portion and the second light source supporting portion support the first light source and the second light source so that the first light source and the second light source are disposed on opposite sides with respect to an optical axis of the projection lens, the first reflector is disposed on a side opposite to the first light source with respect to the optical axis of the projection lens, and the second reflector is disposed on a side opposite to the second light source with respect to the optical axis of the projection lens.

2. The lamp unit according to claim 1, wherein the second reflector is disposed at a position that is closer to the projection lens than the first light source.

3. The lamp unit according to claim 1, wherein the first reflector and the second reflector are arranged so as to face each other and the first light source supporting portion and the second light source supporting portion support the first light source and the second light source, respectively, so that part of an optical path from the first light source to the first reflector and part of an optical path from the second light source to the second reflector overlap each other.

4. The lamp unit according to claim 3, wherein the first reflector has an aperture that has at least one of a function of avoiding interference between the first reflector and the second light source and a function of allowing the light emitted by the second light source to pass toward the second reflector.

5. The lamp unit according to claim 4, wherein the first reflector is provided with a level difference between opposite edges of the aperture.

6. The lamp unit according to claim 1, wherein the first reflector has a reflecting surface along a first ellipse that has focuses at a center of light emission of the first light source and at a light-source side focal point of the projection lens in a plane including the optical axis, the second reflector has a reflecting surface along a second ellipse that has focuses at a center of light emission of the second light source and at the light-source side focal point of the projection lens in the plane, and substantially half or more of a quarter of the first ellipse and substantially half or more of a quarter of the second ellipse overlap each other when viewed along the optical axis in the plane, the quarter of the first ellipse being on a side far from the projection lens and on a second light source side in the first ellipse, the quarter of the second ellipse being on the side far from the projection lens and on a first light source side in the second ellipse.

* * * * *